US010676906B1

(12) United States Patent
Herrin et al.

(10) Patent No.: US 10,676,906 B1
(45) Date of Patent: Jun. 9, 2020

(54) CONTROL SYSTEM FOR PNEUMATICALLY OPERATED TOILET

(71) Applicants: Robert M. Herrin, Orlando, FL (US); Derrick W. Bradshaw, Nahunta, GA (US)

(72) Inventors: Robert M. Herrin, Orlando, FL (US); Derrick W. Bradshaw, Nahunta, GA (US)

( * ) Notice: Subject to any disclaimer, the term of this patent is extended or adjusted under 35 U.S.C. 154(b) by 0 days.

(21) Appl. No.: 15/892,924

(22) Filed: Feb. 9, 2018

Related U.S. Application Data

(60) Provisional application No. 62/457,250, filed on Feb. 10, 2017.

(51) Int. Cl.
*E03D 5/10* (2006.01)
*E03F 1/00* (2006.01)
*E03D 5/012* (2006.01)

(52) U.S. Cl.
CPC ..... *E03D 5/10* (2013.01); *E03D 5/012* (2013.01); *E03F 1/006* (2013.01)

(58) Field of Classification Search
CPC . E03D 5/10; E03D 5/024; E03F 1/006; B60R 15/04; B61D 35/005; B64D 11/02
USPC ..... 4/431–435, 316, 324, 441
See application file for complete search history.

(56) References Cited

U.S. PATENT DOCUMENTS 3,968,526 A 7/1976 Harrah
4,156,297 A * 5/1979 Pilolla ..... B61D 35/007 210/143
4,253,255 A * 3/1981 Durell ..... E02F 3/90 37/195
4,700,884 A * 10/1987 Barrett ..... E03C 1/05 126/362.1
4,815,150 A * 3/1989 Uhlmann ..... E03D 5/10 4/305
5,150,692 A * 9/1992 Trombley ..... F02D 7/02 123/494
6,085,366 A * 7/2000 Pondelick ..... E03D 5/024 4/321
6,349,424 B1 * 2/2002 Stradinger ..... E03D 3/02 4/378
6,804,840 B2 * 10/2004 Berman ..... B60R 15/04 4/323
8,499,369 B2 * 8/2013 Ahmady ..... E03D 1/14 4/388
2008/0279641 A1 * 11/2008 Critelli ..... B65D 88/703 406/137
2014/0020166 A1 * 1/2014 Metcalf ..... E03D 13/007 4/301

* cited by examiner

*Primary Examiner* — Erin Deery
(74) *Attorney, Agent, or Firm* — Allen Dyer Doppelt & Gilchrist, PA

(57) ABSTRACT

A control system for a pneumatically operated toilet includes a valve arrangement and a controller. The valve arrangement includes a plurality of solenoid operated valves. The controller includes a microprocessor in signal communication with the plurality of solenoid operated valves, the controller configured to operate the valve arrangement to independently control operation of a water valve for selectively introducing water into a toilet bowl of the pneumatically operated toilet, operation of a flapper valve operating cylinder for opening and closing a waste opening of the toilet bowl, and pressurized air supply to a waste transfer chamber of the pneumatically operated toilet.

20 Claims, 3 Drawing Sheets

CONTROL SYSTEM FOR PNEUMATICALLY OPERATED TOILET

CROSS-REFERENCE TO RELATED APPLICATION

This application claims the benefit of U.S. Provisional Application Ser. No. 62/457,250, filed on Feb. 10, 2017, the contents of which are herein incorporated by reference in their entirety.

FIELD OF THE INVENTION

The present invention relates to pneumatically operated toilets, and more particularly, to control systems governing the operation thereof.

BACKGROUND OF THE INVENTION

Pneumatically operated toilets are commonly found in railroad cars, cruise ships, airplanes and the like, where the space and/or water constraints render conventional flush toilets impractical. A typical pneumatically operated toilet includes a bowl with a waste opening proximate the bottom thereof and a water inlet near the rim. The waste opening communicates with a waste transfer chamber thereunder and is selectively closed and opened by a flapper valve. The waste transfer chamber connects to an evacuation line, via which waste and water are removed from the waste transfer chamber by air pressure. The flapper valve and a water inlet valve are typically also pneumatically operated.

In typical operation, in a "ready-for-use" state, the waste transfer chamber is depressurized and empty, the flapper valve is closed, and a small amount of water is held in the basin. After use, in response to user operation of a flush button or lever, the flapper valve is opened and additional water is introduced via the water inlet to transfer waste into the waste transfer chamber. After flapper valve is closed, water flow is stopped after the small amount of water normally retained in the bowl is reintroduced. The waste transfer chamber is pressurized to impel the waste and water out via the evacuation line.

Conventionally, all of these operations (i.e., control of the water inlet, the movement of the flapper valve, and the pressurization of the waste transfer chamber) are controlled by a single, pneumatically-operated spool valve. An example of this valve can be seen in U.S. Pat. No. 3,968,526, the contents of which are herein incorporated by reference in their entirety. While this type of spool valve control has proven useful, further improvements are possible.

SUMMARY OF THE INVENTION

In view of the foregoing, it is an object of the present invention to provide an improved control system for a pneumatically operated toilet, as well as related apparatus and methods. According to an embodiment of the present invention, a control system for a pneumatically operated toilet includes a valve arrangement and a controller. The valve arrangement includes a plurality of solenoid operated valves. The controller includes a microprocessor in signal communication with the plurality of solenoid operated valves, the controller configured to operate the valve arrangement to independently control operation of a water valve for selectively introducing water into a toilet bowl of the pneumatically operated toilet, operation of a flapper valve operating cylinder for opening and closing a waste opening of the toilet bowl, and pressurized air supply to a waste transfer chamber of the pneumatically operated toilet.

According to an aspect of the present invention, the timing of the control operations is independently variable using the controller. According to another aspect of the present invention, the controller is further configured to automatically adjust control operations based on one or more sensed parameters of the pneumatically operated toilet. According to a further aspect, a service device is connectable to the controller to retrieve information of toilet parameters, system performance and settings, and to allow manual control operation and setting reconfiguration.

These and other objects, aspects and advantages of the present invention will be better appreciated in view of the drawings and following detailed description of preferred embodiments.

DETAILED DESCRIPTION OF PREFERRED EMBODIMENTS

Figure 1:
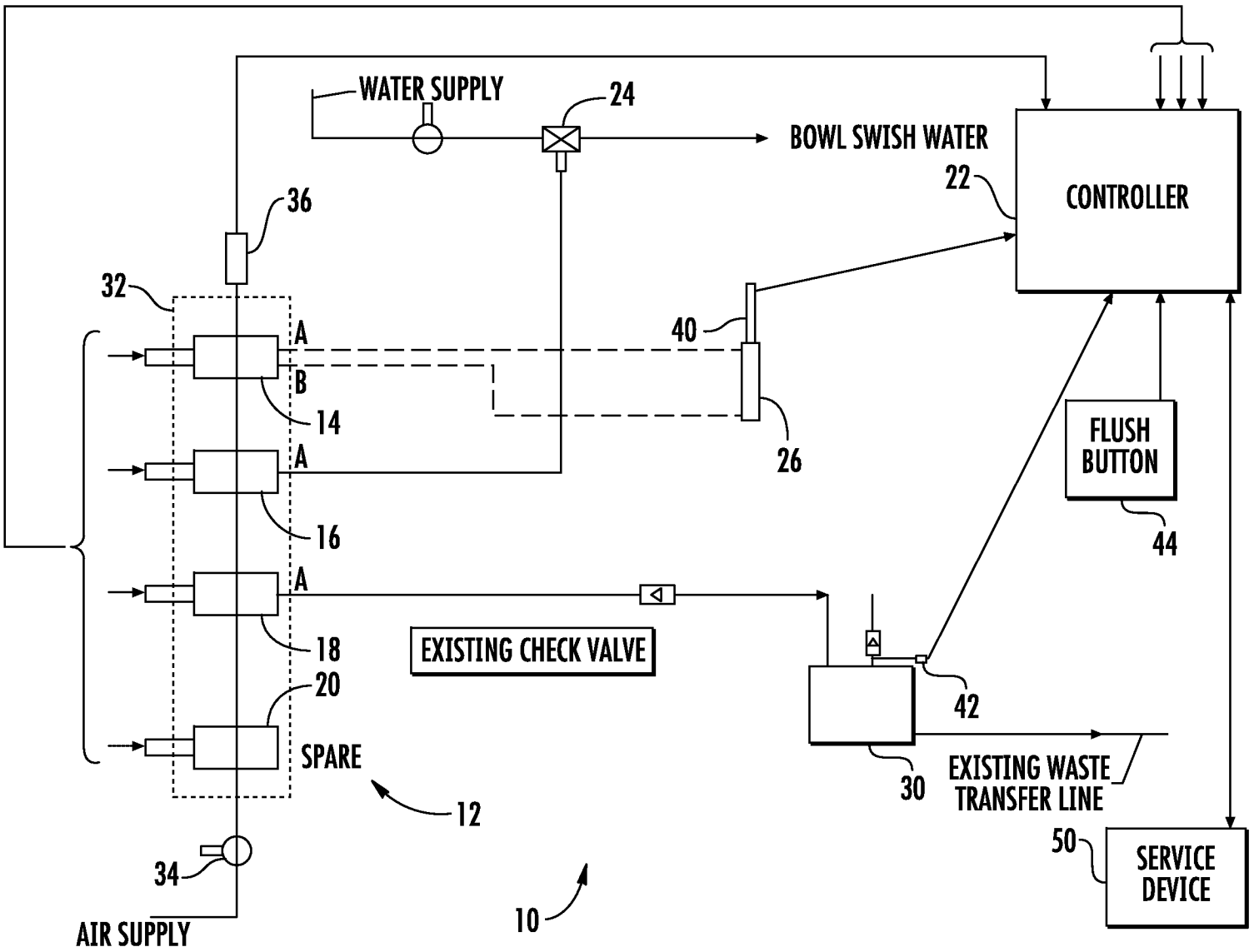
FIG. 1 is a schematic overview of a control system for a pneumatically operated toilet.
Figure 2:
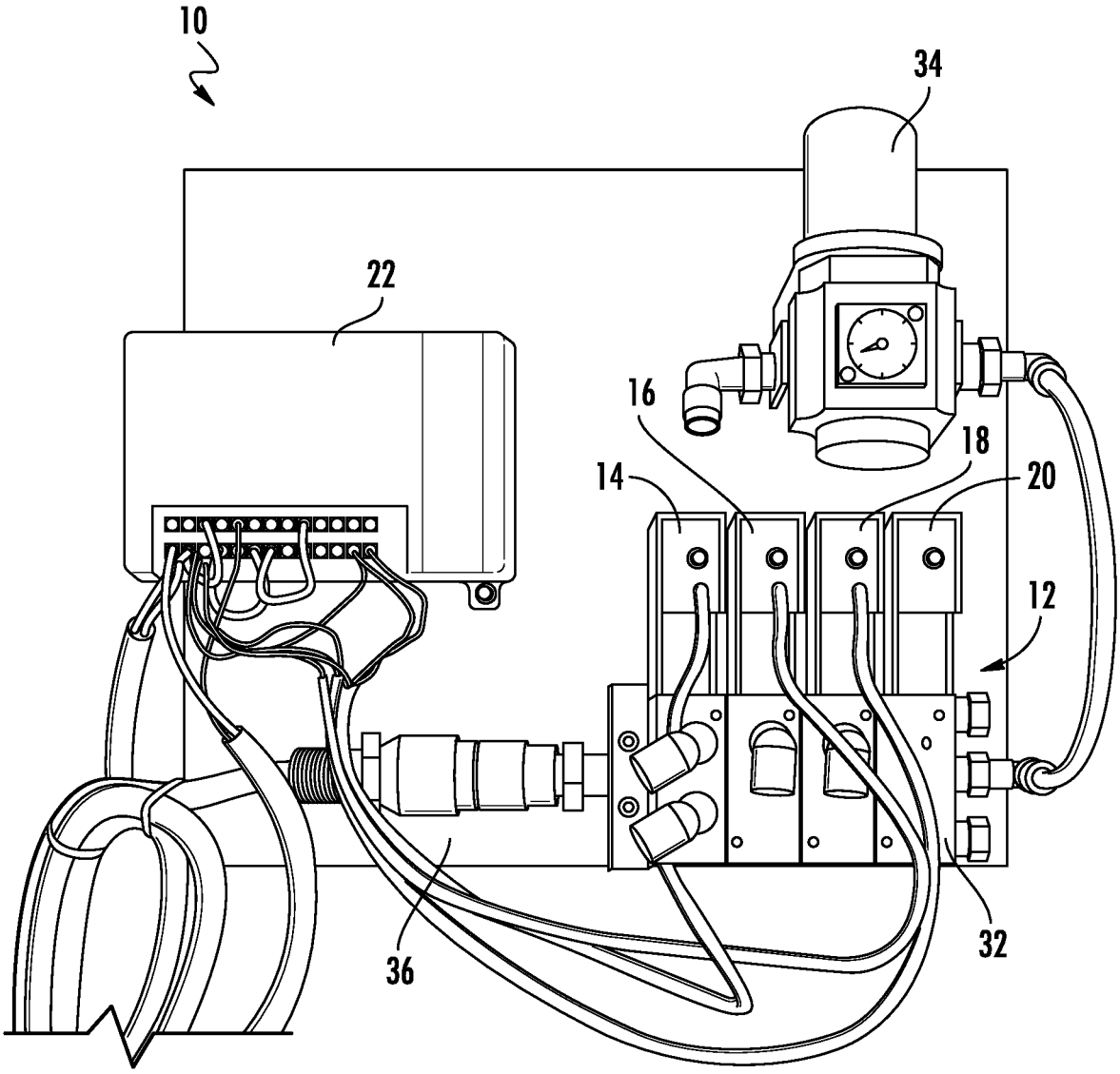
FIG. 2 is a perspective view of components of the control system of FIG. 1.

Referring to FIGS. 1 and 2, a control system 10 for a pneumatically operated toilet includes a valve arrangement 12 including a plurality of solenoid operated valves 14-20 individually operable by a controller 22. Via the valve arrangement 12, the controller 22 is able to independently control the operation of a water valve 24 for selectively introducing water into a toilet bowl, a flapper valve operating cylinder 26 for opening and closing a waste opening of the toilet bowl and to control the supply of pressurized air to a waste transfer chamber 30.

The valve arrangement 12 preferably includes a valve manifold 32 to which the valves 14-20 are commonly mounted. The valve manifold receives pressurized air from an air supply connection via a pressure regulator 34. Advantageously, a pressure sensor 36 senses manifold pressure and communicates the pressure to the controller 22.

The valve 14 is a five-way, two position solenoid valve and has two outlets respectively connecting to open and close sides of the flapper cylinder 26. The normal valve 14 position is ported to the close side of the flapper cylinder 26. Advantageously, a position sensor 40 is associated with the flapper cylinder or flapper valve, which inputs flapper valve position to the controller 22.

The valve 16 is a normally closed two-way solenoid valve which, when open, ports air to a pilot port of the water valve 24, causing the valve 24 to open and admit water to the bowl. Closure of the valve 16 will result in reclosing of the water valve 24 and cessation of water flow into the bowl.

The valve 18 is a normally closed two-way solenoid valve that ports air to the waste transfer chamber 30 to impel waste and water therefrom. Preferably, a pressure sensor 42 senses air pressure in the chamber 30 and communicates it to the controller 22. Closure of the valve 18 will cease air flow to the waste transfer chamber 30, allowing excess pressure to eventually vent off.

The valve 20 is an installed spare that could be connected to replace either of the valves 16 or 18. Alternately, the valve 20 could be omitted.

The controller 22 is preferably a programmable logic controller (PLC), although other micro-processor controlled devices could be employed. In normal operation, the controller 22 receives a flush input via a flush button 44, and operates the valve arrangement 12 per the following sequence:

TABLE I

NORMAL FLUSH SEQUENCE

| Time | Action |
|---|---|
| T0 | Receive flush button input. |
| T1 | Operate valve 14 to open the flapper valve. |
| T2 | Operate valve 16 to initiate water flow to the bowl. |
| T3 | Operate valve 14 to close the flapper valve. |
| T4 | Operate valve 18 to initiate air flow to waste transfer chamber 30. |
| T5 | Operate valve 16 to secure water flow to the bowl. |
| T6 | Operate valve 18 to secure air flow to waste transfer chamber 30. |

In contrast to the prior art spool valve, the controller 22 allows each of the times T1-T6 to be adjusted completely independent of the others. While the rate of spool valve motion could be adjusted, thereby speeding or slowing the entire cycle of flushing operation, the relative initiation times of each action would still be mechanically tied to movement of the spool valve.

The independent control afforded by the present invention affords various advantages. For example, if available water pressure were lower than anticipated, the controller 22 could be programmed to increase the time intervals between T1 and T3, as well as between T2 and T5, without changing the time intervals between T3, T4 and T6—which would help compensate for a sub-optimal water pressure without wasting air.

Additionally, the flushing operation can be automatically modified based on real-time feedback. For instance, if the position sensor 40 detects the flapper valve has not actually closed fully (i.e., due to blockage), the controller 22 can automatically prevent the subsequent opening of valve 18 to prevent pressurized air, along with any water and entrained waste, from escaping back into the bowl. Similarly, the controller 20 can automatically adjust the interval between T4 and T6 based upon the actual pressure sensed in the waste transfer chamber 30.

Beyond adjustments to facilitate toilet use, the system 10 allows improved functionality for monitoring and maintenance. A service device 50 is connectable to the controller 22, and allows a technician to view and manually adjust the timing of steps of the flush sequence, check current and logged indications from the sensors 36, 40 and 42, add, delete or modify automatic actions, and manually and independently cycle the valves 14-20 of the valve arrangement 12.

Figure 3:
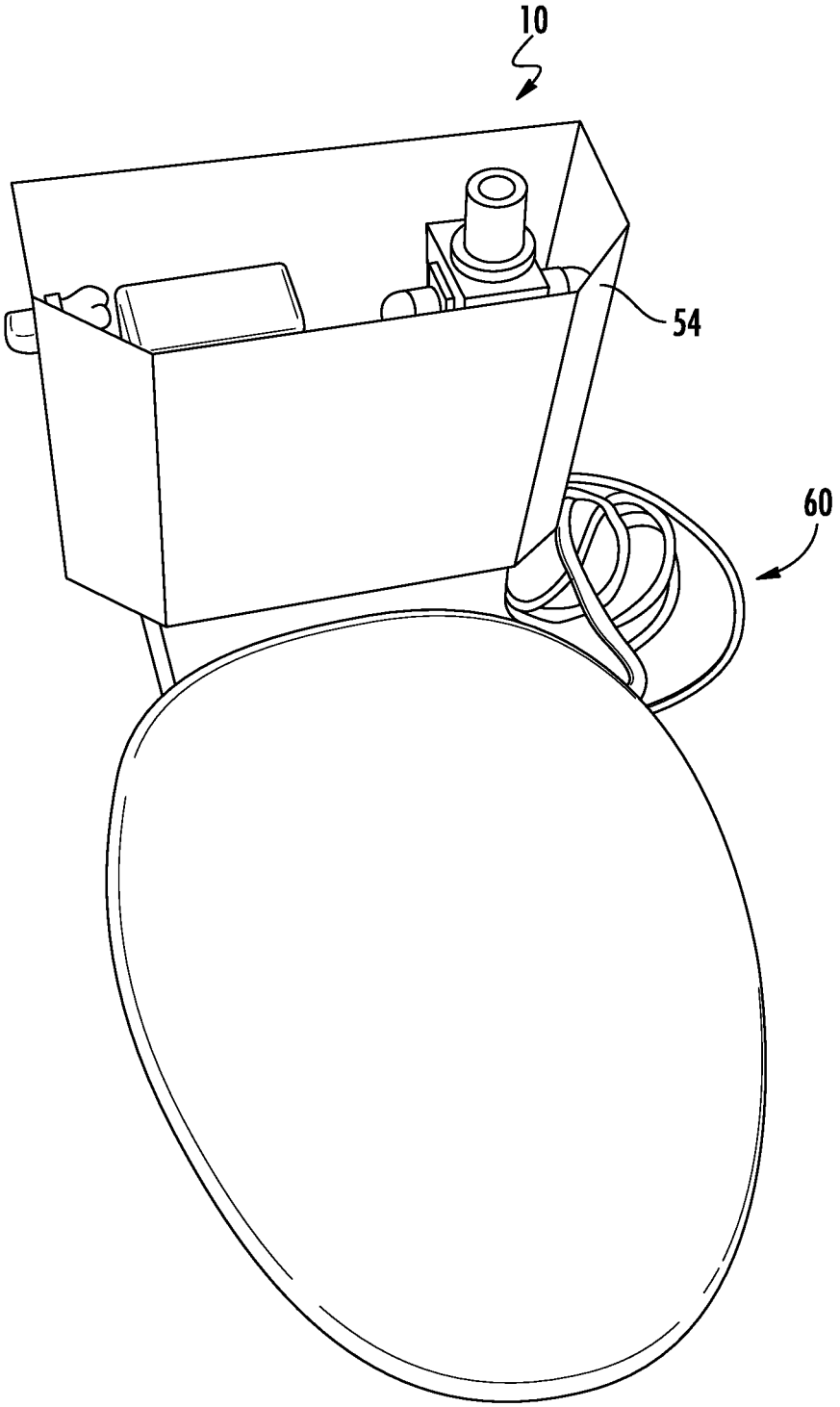
FIG. 3 is a perspective view of the system of FIG. 1, mounted in a rear chamber of a pneumatically operated toilet.

As seen in FIG. 2, the valve arrangement 12 and controller 22 can be commonly mounted on a panel 52 or other frame or support, which (referring to FIG. 3) allows the system 10 to be easily retrofitted into the rear chamber 54 of an existing pneumatically operated toilet 60, with air and electrical connections being made to existing components as needed.

The foregoing description is provided for illustrative and exemplary purposes; the present invention is not necessarily limited thereto. Rather, those skilled in the art will appreciated that various modifications, as well as adaptations to particular circumstances, are possible within the scope of the invention as herein shown and described and of the claims appended hereto.

What is claimed is:

1. A pneumatically operated toilet system installed in a railroad car, the toilet system comprising:

a pneumatically operated toilet including:

a toilet bowl having a waste opening;

a waste transfer chamber connected to the toilet bowl via the waste opening;

a flapper valve positionable to selectively open and close the waste opening;

a flapper valve operating cylinder operable to reposition the flapper valve;

a flapper valve position sensor operable to detect position of the flapper valve;

an air supply connection;

a water supply connection;

a water valve operable to open and close the water supply connection, the water valve having a pilot port; and a waste transfer line connected to the waste transfer chamber;

a control system including:

a valve arrangement having a plurality of solenoid operated pneumatic valves, including at least:

a first solenoid operated pneumatic valve controlling supply of pressurized air from the air supply connection to the flapper valve operating cylinder;

a second solenoid operated pneumatic valve controlling porting of pressurized air from the air supply connection to the pilot port of the water valve for selectively introducing water from the water supply connection into the toilet bowl of the pneumatically operated toilet; and a third solenoid operated pneumatic valve for controlling the supply of pressurized air from the air supply connection to the waste transfer chamber; and a programmable logic controller including a microprocessor in signal communication with the plurality of solenoid operated valves and the flapper valve position sensor, the programmable logic-controller configured to operate the valve arrangement to independently control operation the plurality of solenoid operated valves;

wherein first solenoid operated pneumatic valve is a five-way, two position solenoid valve having two outlets operable to port pressurized air from the air supply connection to opening and closing sides of the flapper valve operating cylinder so as to operate the flapper valve operating cylinder to, respectively, open and close the flapper valve; and wherein the programmable logic controller is further configured with program instructions such that, if the flapper valve position sensor indicates that the flapper valve is not closed, then the controller will not operate the third solenoid operated pneumatic valve to supply pressurized air to the waste transfer chamber.

2. The control system of claim 1, wherein the valve arrangement includes a valve manifold to which the plurality of solenoid operated pneumatic valves are commonly mounted.

3. The control system of claim 1, further comprising a pressure regulator in the air supply connection.

4. The control system of claim 1, further comprising an air supply pressure sensor operable to detect air supply pressure in the air supply connection and communicate the air supply pressure to the programmable logic controller.

5. The control system of claim 1, wherein a normal position of the five-way, two position solenoid valve is positioned to port pressurized air from the air supply connection to the closing side of the flapper valve operating cylinder.

6. The control system of claim 1, wherein the flapper valve position sensor detects position of the flapper valve directly.

7. The control system of claim 1, wherein the flapper valve position sensor detects position of the flapper valve indirectly by detecting position of the flapper valve operating cylinder.

8. The control system of claim 1, wherein the second solenoid operated valve is two-way solenoid valve operable to port pressurized air to the pilot port of the water valve.

9. The control system of claim 8, wherein the second two-way solenoid valve is normally closed.

10. The control system of claim 1, wherein the third solenoid operated valve is a two-way solenoid valve operable to port pressurized air to the waste transfer chamber.

11. The control system of claim 10, wherein the third two-way solenoid valve is normally closed.

12. The control system of claim 10, further comprising a waste transfer chamber pressure sensor operable to detect waste transfer chamber air pressure and communicate the waste transfer chamber air pressure to the programmable logic controller.

13. The control system of claim 12, wherein the programmable logic controller is further configured with software instructions to adjust the operating time of the third solenoid operated pneumatic valve after operating the first solenoid operated pneumatic valve to close the flapper valve based on the waste transfer chamber air pressure detected by the waste transfer chamber pressure sensor.

14. The pneumatically operated toilet assembly of claim 1, wherein the valve arrangement and programmable logic controller are commonly mounted on a support located in a rear chamber located above the toilet bowl.

15. A method of operating a pneumatically operated toilet using the system of claim 1, the method comprising:

at time T0, receiving a flush button input at the programmable logic controller;

at time T1, operating the second solenoid operated pneumatic valve to use the water valve to begin introducing water into the toilet bowl;

at time T2, operating the first solenoid operated valve to use the flapper valve operating cylinder to open the flapper valve;

at time T3, operating the first solenoid operated pneumatic valve to use the flapper valve operating cylinder to close the flapper valve;

at time T4, operating the third of the plurality of solenoid operated pneumatic valve to initiate pressurized air flow to the waste transfer chamber;

at time T5, operating the second solenoid operated pneumatic valve to use the water valve to stop introducing water into the toilet bowl; and at time T6, operating the third solenoid operated pneumatic valve to secure pressurized air flow to the waste transfer chamber.

16. The method of claim 15, further comprising independently adjusting each of the times T1-T6 using the programmable logic controller.

17. The method of claim 15, further comprising automatically adjusting at least one of the times T1-T6 using the programmable logic controller based on at least one sensed parameter.

18. The method of claim 17, wherein the at least one sensed parameter is sensed water pressure, and automatically adjusting at least one of time times T1-T6 using the programmable logic controller includes automatically adjusting the intervals between T1 and T3 and between T2 and T5.

19. The method of claim 17, wherein the at least one sensed parameter is sensed air pressure in the waste transfer chamber, and automatically adjusting at least one of time times T1-T6 using the programmable logic controller includes automatically adjusting the interval between T4 and T6.

20. The method of claim 17, wherein the at least one sensed parameter is sensed flapper valve position, and automatically adjusting at least one of time times T1-T6 using the programmable logic controller includes automatically delaying T4 if the sensed flapper valve position indicates that the flapper valve is not closed.

* * * * *